United States Patent [19]

Teng

[11] Patent Number: 4,852,283

[45] Date of Patent: Aug. 1, 1989

[54] ROTATABLY-TWISTING DISPLAY DEVICE

[76] Inventor: Hsieh-Yih Teng, P.O. Box 20-5, Hsinchu, Taiwan

[21] Appl. No.: 216,515

[22] Filed: Jul. 8, 1988

[51] Int. Cl.[4] ..... G09F 19/00

[52] U.S. Cl. ..... 40/426; 40/433; 446/134

[58] Field of Search ..... 40/426, 431, 455, 457, 40/410, 474, 433; 446/131, 133, 134, 135, 136; 362/101, 123, 124

[56] References Cited

U.S. PATENT DOCUMENTS

| | | | |
|---|---|---|---|
| 3,006,111 | 10/1961 | Koch | 40/426 |
| 3,239,956 | 3/1966 | Canonica, Jr. | 446/134 |
| 3,425,157 | 2/1969 | Hartsock | 446/134 |
| 4,490,931 | 1/1985 | Fleemin | 40/409 |

FOREIGN PATENT DOCUMENTS

| | | | |
|---|---|---|---|
| 850769 | 12/1939 | France | 362/101 |

*Primary Examiner*—Gene Mancene
*Assistant Examiner*—Cary E. Stone

[57] ABSTRACT

A display device includes: a base, a crystal ball mounted on the base, an inner cylinder plugged in an opening of the crystal ball, a musical base driving a lower disk having a plurality of magnets fixed thereon, a creature mounted on an upper disk rotatably mounted on an upper portion of the inner cylinder having ferrous plates formed in the upper disk, so that upon a driving of a shaft of the musical box, the creature mounted on the upper disk will be rotated as magnetically attracted by the lower disk to vividly pose like a sportsman's action.

4 Claims, 3 Drawing Sheets

ROTATABLY-TWISTING DISPLAY DEVICE

BACKGROUND OF THE INVENTION

Kotzin disclosed an "audio-visual display device" in his U.S. Pat. No. 4,240,218 having a model rotatably held within a terrarium housing by securing the model on a capstan 48 which is jacketed in a bearing tube 46 and driven by a driving mechanism such as a musical device 50. However, the model capstan or shaft is pivotally mounted through a bottom plate of the housing and a water leakage may be caused through an aperture between the shaft and the casing.

Meanwhile, the model or creature is made as a fixed type to be lacking of vividness so that such a display device can not provide a better decorative effect to livingly mimic a sportsman's action.

The present inventor has found the drawbacks of a conventional display device and invented the present rotatably-twisting display device.

SUMMARY OF THE INVENTION

The object of the present invention is to provide a display device including: a base, a crystal ball mounted on the base, an inner cylinder plugged in an opening of the crystal ball, a musical base or a motor driving a lower disk having a plurality of magnets fixed thereon, a creature mounted on an upper disk rotatably mounted on an upper portion of the inner cylinder, having ferrous plates formed in the upper disk so that upon a driving of a shaft of the musical box, the creature mounted on the upper disk will be rotated as magnetically attracted by the lower disk to vividly pose like a sportsman's action.

DETAILED DESCRIPTION

Figure 1:
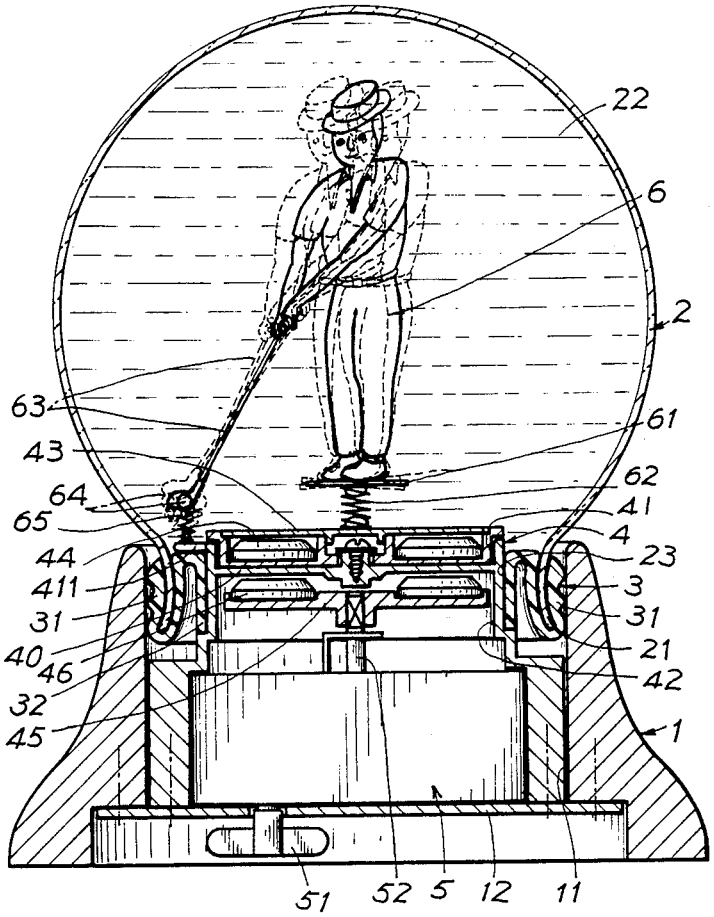
FIG. 1 is an illustration of the present invention showing a golf player formed therein.

As shown in FIG. 1, the present invention comprises: a base 1, crystal ball 2 generally formed as a spherical shape, a packing 3, an inner cylinder 4, a driving means 5 such as a motor or a spring of a musical device, and a model creature 6.

The base 1 is formed an inner cylindrical hole 11 for mounting a neck portion 21 of the crystal ball 2 on an upper portion of the base 1 by an outer skirt 31 of a packing 3. Inside the crystal ball 2, there is filled with water 22 when mounting a creature 6 in the ball 2. An inner cylinder 4 is inserted into a ball opening 23 and packed by an inner skirt 32 of the packing 3.

The inner cylinder 4 includes: an upper cylindrical socket 41 for rotatably mounting therein an upper disk 43 having a plurality of ferrous plates 44 formed in the disk 43, and a lower cylindrical socket 42 for rotatably mounting therein a lower disk 45, having a plurality of magnets 46 formed in the disk 45, the lower disk 45 being fixed on a shaft 52 of a musical device 5 which is driven by a spring system (not shown) inside the device 5, when storing a resilience energy by rotating a handle 51 under the bottom of the musical device 5. The musical device 5 is secured on a lower portion of the inner cylinder 4 by a fixing plate 12 which is also secured to a lower portion of the base 1. The musical device 5 may also be substituted with a motor (not shown) or other driving spring. The upper socket 41 is separated from the lower socket 42 by a partition plate 40 so that the creature 6 mounted on the upper disk 43 is water tight for the lower socket 42.

The model creature 6 includes a foot stand 61 for erecting the creature 6 thereon, a central spring 62 retaining the foot stand 61 on a central portion of the upper disk 43, a side actuator member 63 having its upper end secured to the creature 6, and a side follower means 64 resiliently held on a flange 411 laterally extending from an upper edge of the inner cylinder 4 by a side spring 65 secured to the flange 411. The side actuator member 63 operatively defines a circle rotatively engaged with the side follower means 64 when rotating the creature 6 as magnetically driven by the lower disk 45.

As shown in FIG. 1, the creature 6 is a golf player and the side actuator member 63 is thus defined as a club and the follower means 64 defined as a golf ball, whereby upon a rotation of said lower disk 45 to rotate the upper disk 43 and the golfer, the club 63 will be driven to hit the ball 64 when the club 63 meeting the ball 64, and after the collision of the club 63 with the ball 64, both central spring 62 and side spring 65 may vibrate or twist the player 6 and the ball 64 in a vivid and interesting manner.

Figure 2:
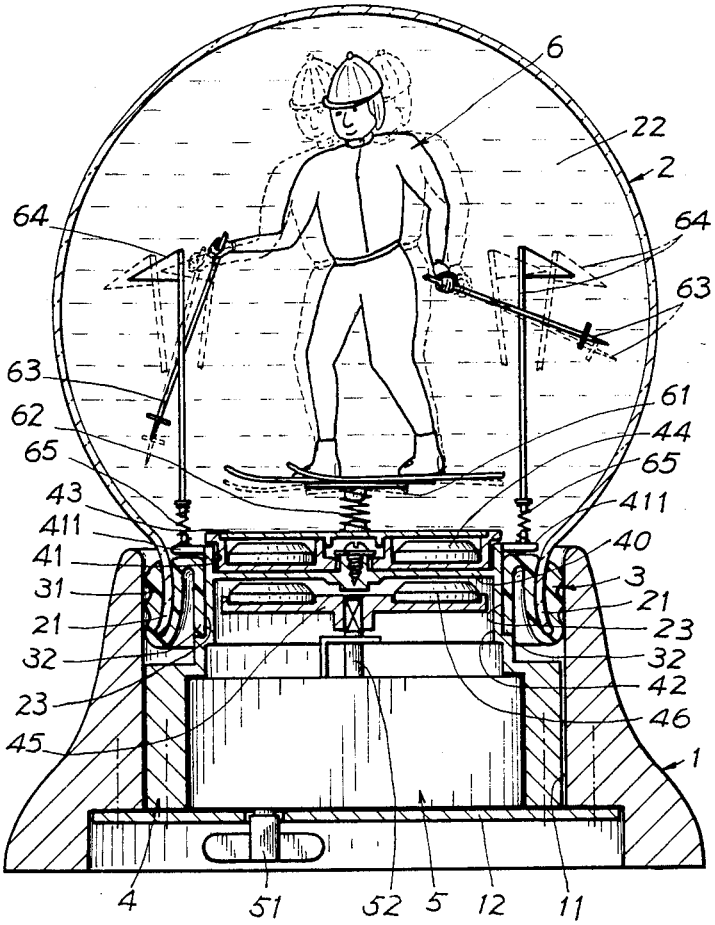
FIG. 2 is an illustration of another preferred embodiment of the present invention having a skier creature formed therein.

As shown in FIG. 2, the creature 6 may be modified as a skier and the side actuator member 63 may be made as two skiing sticks and the side follower means 64 made as two flag poles to imitate a skiing action.

Figure 3:
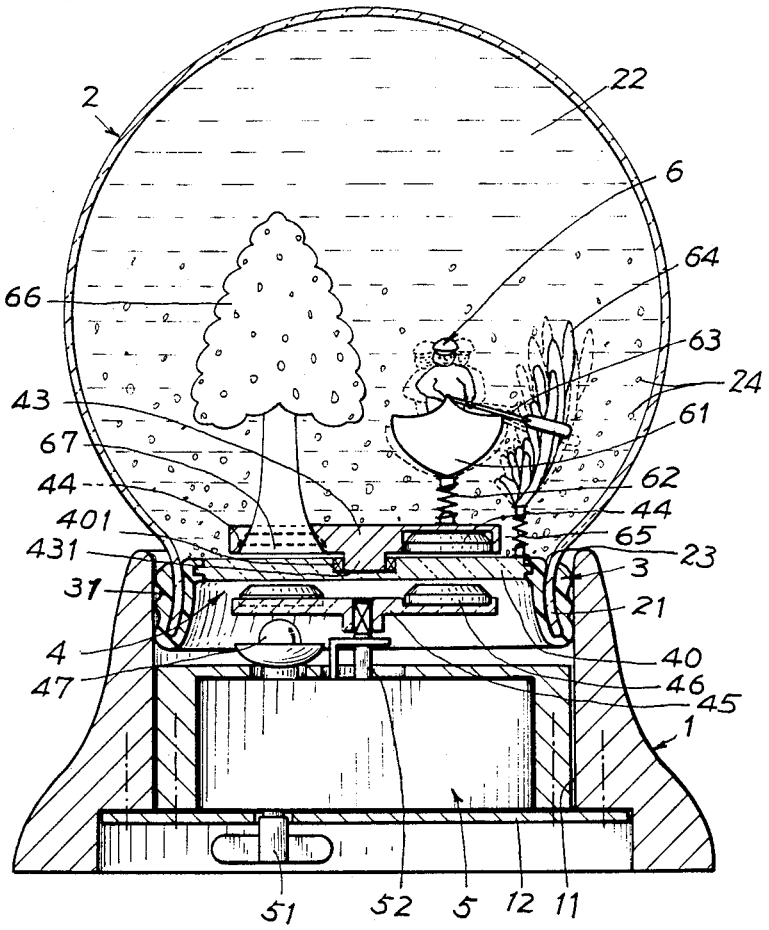
FIG. 3 shows another preferred embodiment of the present invention.

As shown in FIG. 3, still another preferred embodiment of the present invention comprises: a first creature 6 such as a man sitting on a boat 61 held on the upper disk 43 by spring 62 and rowing a paddle 63 resiliently impacting a side grass 64 resiliently held on a side edge of the packing 3 by a side spring 65 so as to disturb debris or precipitates 24 to whirl such debris to mimic a rain or snowfall, a second creature 66 such as a transparent tree having an enlarged base portion 67 engaged in the upper disk 43 having a central stem 431 rotatably mounted in a socket 401 in a transparent plate 40 embedded in a central portion of the packing 3 sealing a ball opening 23, a lower disk 45 having a major portion thereof made as transparent besides the magnets 46 for transmitting light projecting upwardly from a bulb 47 positioned under the disk 45, so that upon a rotation of the lower disk to drive the upper disk 43, the tree 66 once projectively meeting the light from the bulb 47 will be illuminated and when the disk 43 having its opaque portion projectively meeting the light from bulb 47 will shield the light to darken the tree 66, resulting in a flashing effect of the tree 66 when rotating the disks 45, 43.

For simplifying purpose, the creature 6 may be made as a single creature without the spring 62, an animal, a plant, or any other decorative articles for other display or ornamental uses. The packing 3 may be formed a disk-like plate sealing the opening of ball 2 by eliminating the cylinder 4 (FIG. 1) or the transparent plate 40 (FIG. 3).

The present invention is superior to prior Kotzin's device with the following advantages:

1. The creature is separated from the lower disk and musical device, both being magnetically attracted with each other, thereby preventing any water leakage problem as no shaft is pivotally protruding through the disks.

2. The creature 6 having the actuator member 63 is resiliently standing on the upper disk, while a side follower means is resiliently secured on a side flange outside the upper disk so that the creature may rotatably strike the side follower means to vividly mimic a ball-playing or other striking actions of a sportsman or the like.

I claim:

1. A rotatably-twisting display device comprising:

a base having an inner cylindrical hole formed therein;

a crystal ball generally formed as a spherical shape for filling water therein having a neck portion mounted on an upper portion in said cylindrical hole of said base and sealed therein by an outer skirt of a packing;

an inner cylinder having an upper socket having an upper disk mounted with ferrous plates in the upper disk rotatably mounted in said upper socket, and a lower socket partitioned under said upper socket having a lower disk rotatably mounted in said lower socket and fixed with a plurality of magnets on the lower disk to magnetically attract said ferrous plates in said upper disk, said lower disk being fixed on a shaft of a spring system of a musical device mounted on a lower portion inside said inner cylinder, said inner cylinder being inserted into an opening of said neck portion and sealed therein by an inner skirt of a packing and mounted to said base by a bottom plate; and at least a model creature mounted on a foot stand resiliently held on said upper disk by a central spring, having a side actuator member having its upper end secured to a central creature and having its lower end rotatably striking a side follower means resiliently mounted by a side spring on a flange laterally extending from an upper edge of said inner cylinder outside the upper disk, whereby upon a rotation of said lower disk to drive the upper disk as magnetically attracted to said lower disk to rotate the creature, the side actuator member may hit the side follower means to cause a twisting or vibration action of the creature and the side follower means to vividly mimic a sportsman's action or the like.

2. A display device according to claim 1, wherein said side actuator member is formed as two sets to be held by two hands of the creature and said side follower means is also formed as two sets to be rotatively hit by said two side actuator members.

3. A display device comprising:

a base;

a crystal ball mounted on said base and sealed by a packing generally formed as a disk shape sealing a ball opening defined in a bottle neck of the ball, said ball being filled with water and debris or precipitates therein;

a lower disk having magnets thereon rotatably driven by a motor;

an upper disk pivotally mounted on said packing having ferrous plates formed in said upper disk magnetically attracted to said magnets on said lower disk; and at least a creature resiliently mounted on said upper disk having a side actuating member operatively impacting a side follower means resiliently mounted on a side edge of said packing for whirling up the debris in the ball to mimic a rain or snowfall.

4. A display device comprising:

a base;

a crystall ball filled with water therein and sealably mounted on said base by a packing;

an opaque upper disk rotatably mounted on a transparent plate embedded in said packing having a creature made as transparent mounted on a hole in said upper disk and having ferrous plates formed therein;

a lower disk having a major portion made as transparent and having magnets formed thereon to magnetically attract said ferrous plates in said upper disk, said lower disk being rotatably driven by a motor; and a bulb positioned under the lower disk for lighting said lower disk, said transparent plate and said transparent creature, said creature being illuminated by said bulb when rotated to projectively meet said bulb, or darkened when the light is shielded by said opaque portion of said upper disk, causing a flashing of said creature.

* * * * *